United States Patent [19]

Biermann et al.

[11] 4,159,737

[45] Jul. 3, 1979

[54] HEAT PIPE

[75] Inventors: Udo K. P. Biermann; Willem L. N. van der Sluys; Johannes C. M. Roelofs, all of Eindhoven, Netherlands

[73] Assignee: U.S. Philips Corporation, New York, N.Y.

[21] Appl. No.: 828,478

[22] Filed: Aug. 29, 1977

[30] Foreign Application Priority Data

Nov. 8, 1976 [NL] Netherlands ..... 7612360

[51] Int. Cl.[2] ..... F28D 15/00

[52] U.S. Cl. ..... 165/105

[58] Field of Search ..... 165/105

[56] References Cited

U.S. PATENT DOCUMENTS

| | | | |
|---|---|---|---|
| 3,503,438 | 3/1970 | Geyer | 165/105 |
| 3,884,296 | 5/1975 | Basiulis | 165/105 X |
| 4,043,387 | 8/1977 | Lamp | 165/105 |

*Primary Examiner*—Albert W. Davis, Jr.

*Attorney, Agent, or Firm*—Thomas A. Briody; William J. Streeter; Rolf E. Schneider

[57] ABSTRACT

A heat pipe contains a getter for gaseous impurities arranged in the vapor space and distributed between the vaporization wall and the condensation wall.

7 Claims, 1 Drawing Figure

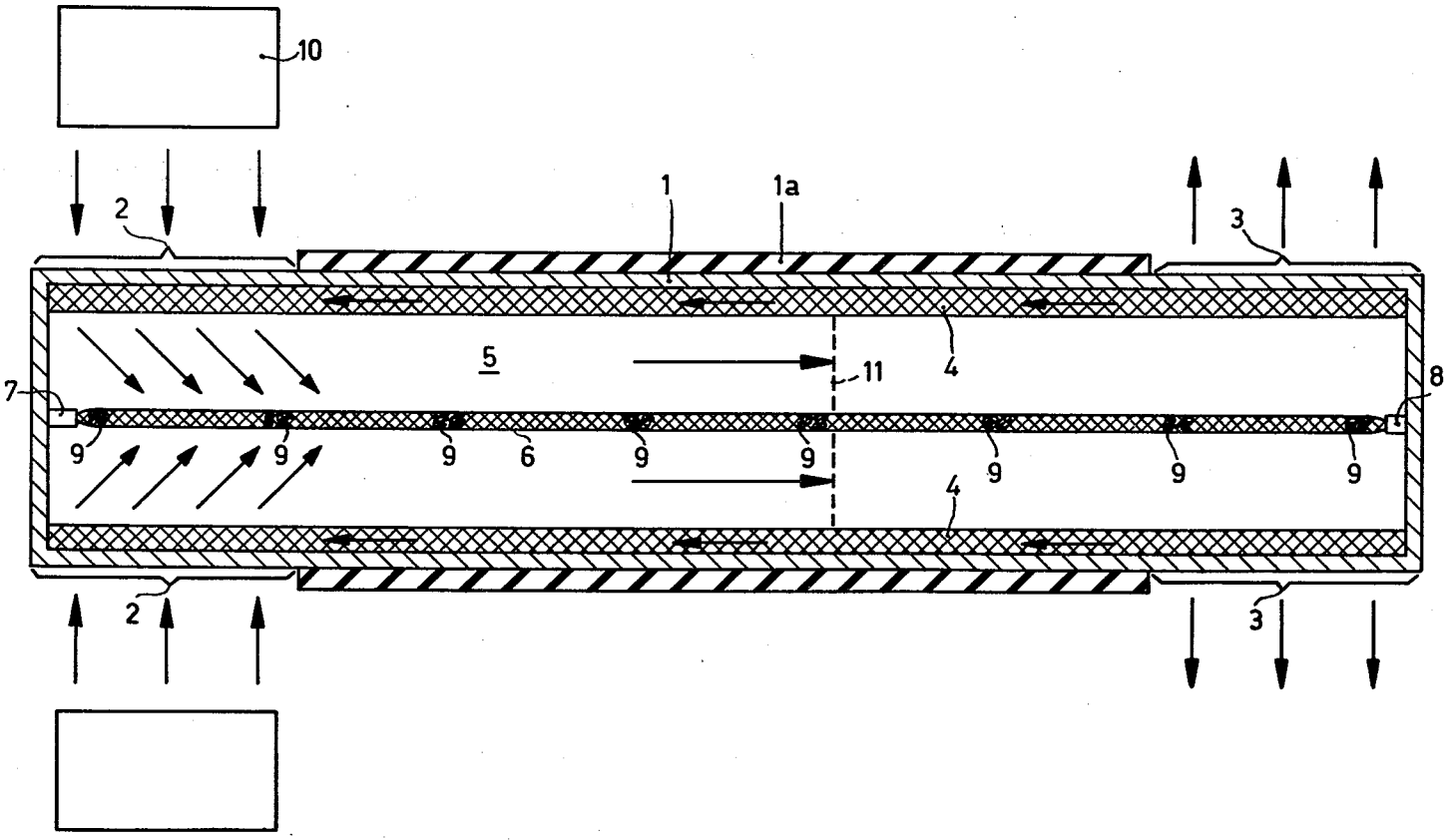
8
9
3
3
9
9
4
4
11
1a
9
1
9
6
5
9
10
9
2
2
9
7

HEAT PIPE

This invention relates to a heat pipe, comprising a closed reservoir having at least one vaporization wall and at least one condensation wall, the said reservoir containing a heat transport medium which flows in the vapour phase from the vaporization wall, via at least one duct for vapour, to the condensation wall during operation, and which returns in the liquid phase, via at least one duct for liquid, to the vaporization wall.

Heat pipes of the described kind are known in a variety of forms, such as tubular (U.S. Pat. No. 3,229,759), flat (U.S. Pat. No. 3,613,778), and double-walled (U.S. Pat. Nos. 3,603,382; 3,651,240 and 3,943,964).

The condensate may be returned from the condensation wall to the vaporization wall by way of a capillary structure which consists, for example, of a metal gauze (U.S. Pat. No. 3,229,759), capillary grooves in the heat pipe wall (U.S. Pat. No. 3,402,767) or a combination thereof (U.S. Pat. No. 3,598,177). Further examples of capillary structures can be found in U.S. Pat. Nos. 3,528,494; 3,537,514 and 3,811,496.

The return of condensate can be further stimulated by the addition of arteries (U.S. Pat. Nos. 3,901,311 and 3,913,664).

The vapour and liquid ducts may directly adjoin each other without partitions (U.S. Pat. No. 3,229,759) or may be accommodated in individual. separated ducts (U.S. Pat. No. 3,543,839).

In order to achieve proper operation of the heat pipe, it is desirable to remove all undesirable gases such as $H_2$, $N_2$, $O_2$ and $CO_2$ from the heat pipe. This is because such gases may cause a variety of difficulties. For example, they may impede the condensation of heat transport medium on the condensation wall in that this wall may be covered by a gas layer, or they may enter into chemical reactions with the heat transport medium, the material of the capillary structure, or that of the heat pipe walls.

Undesirable gases which could be released by the heat pipe walls at the often high operating temperature of the heat pipe, by the capillary structure or by the heat transport medium, can be substantially eliminated in advance by prior purification. for example, the heat transport medium may be distilled and the heat pipe with the capillary structure may be subjected to a heat treatment, for example, annealing in a vacuum furnace, prior to being filled with the heat transport medium and sealing. However, this implies that the manufacturing method is expensive.

The heat pipe can be sealed by means of valves. This on the one hand makes the heat pipe comparatively expensive, whilst on the other hand hermetical sealing is often not obtained, because the valve may readily leak. Undesirable gases then penetrate into the heat pipe where they can cause the already described difficulties.

Because the sealing of the heat pipe is in most cases a non-recurrent operation, use is preferably made of a sealing method such as fusion, soldering or welding in order to obtain a suitable seal, the sealing location being heated at least to the softening temperature in order to obtain the shape desired for sealing (for example, constriction of a filling spout or pumping stem).

However, it is problematic to achieve a simple method of hermetical sealing of a heat pipe which contains a heat transport medium and which is also evacuated to eliminate undesirable gases.

In the case of sealing in a surrounding of atmospheric pressure, implosion of the heat pipe may readily occur at the area of the sealing location upon softening, because vacuum prevails in the heat pipe. Moreover, gases such as air are likely to penetrate into the heat pipe via the location to be sealed, the vacuum thus being lost. Moreover, due to the heating of the sealing location, the evacuated heat pipe usually assumes such a high temperature that it is difficult to handle.

The said drawbacks can be mitigated by performing the sealing by means of electron beam welding or soldering in a vacuum. A method of this kind, however, is time-consuming and expensive and, moreover, requires expensive equipment. When use is made of electron beam welding apparatus, for example, as known from U.S. Pat. No. 3,033,974, only one heat pipe can be welded each time in the apparatus. The heat pipe needs then to be accurately positioned in the treatment chamber. After evacuation of the treatment chamber, electron beam welding can take place. The heat pipe can be removed from the treatment chamber after release of the vacuum therein.

Considering the time-comsuning procedure in the case of electron beam welding and the expensive equipment required, this method is unattractive for economical reasons.

The present invention has for its object to provide a structurally simple heat pipe, whereby the described disadvantages are mitigated.

In order to realize the object, the heat pipe in accordance with the invention is characterized in that in the duct for vapour there is provided at least one getter for gaseous impurities which extends from the vaporization wall to the condensation wall and which is active at least at the operating temperature.

When the heat pipe is put into operation, heat transport medium evaporates from the vaporization wall. The vapour interface then moves through the vapour duct to the condensation wall and heats an increasing quantity of getter on its way. In so far as the getter is not very active already, its getter effect substantially increases as a result of the heating and an increasing amount of gaseous impurities in the vapour duct is bound by the getter in the direction from the vaporization wall to the condensation wall.

A construction of this kind offers major advantages in that the heat pipe, the capillary structure and the heat transport medium need no longer be thoroughly cleaned, in that the heat pipe need no longer be evacuated because atmosphere air is bound by the getter, so that proper heat pipe operation is ensured, and in that the heat pipe can be simply sealed with atmospheric pressure inside and outside the heat pipe.

The construction in accordance with the invention can even be used for heat pipes of the controllable type, comprising a reservoir which contains a control gas which controls the heat-transmitting surface area of the condensation wall (U.S. Pat. Nos. 3,517,730 and 3,613,733), provided that the control gas is a noble gas. This is because noble gases are not bound by getters.

A preferred embodiment of the heat pipe in accordance with the invention is characterized in that the getter is sub-divided into a number of portions which are distributed at regular distances from each other in the duct for vapour over the flow path.

In a further preferred embodiment of the heat pipe in accordance with the invention, the getter is contained in a gas-permeable holder which is connected to the reservoir.

The gas-permeable holder may be formed, for example, by a metal, glass or ceramic sleeve which is provided with openings which are distributed over the circumference.

The holder is preferably made of a roll of metal gauze. This is a simple, inexpensive and light construction. After the provision of chunks of getter on flat gauze, the gauze can be readily rolled.

A still further preferred embodiment of the heat pipe in accordance with the invention, in which the heat transport medium is sodium, potassium or cesium or a mixture thereof, is characterized in that the getter consists of one of more of the elements lanthanum, yttrium and scandium. One or more of these latter elements may be combined with one or more of the elements barium, calcium and lithium.

High-performance heat pipes are obtained by means of these getters in the vicinity of the said heat transport media.

The invention will now be described in detail hereinafter with reference to the accompanying drawing.

The single FIGURE shows a longitudinal sectional view of a heat pipe comprising a closed reservoir 1, a heat insulating layer 1*a*, a vaporization wall 2, a condensation wall 3 and a capillary structure in the form of a gauze layer 4 on the inner surface of the reservoir 1, the said gauze layer connecting the condensation wall 3 to the vaporization wall 2.

The reservoir 1 contains a quantity of heat transport medium, for example, sodium.

Centrally inside the vapour space 5 there is arranged a gauze roll 6 of, for example, chromium nickel steel (mesh width, for example, 1 mm and wire thickness, for example, 0.4 mm), the said roll being connected to the reservoir 1 at the areas 7 and 8. Inside the gauze roll 6 there are locally provided at regular or irregular intervals chunks 9 of a getter for gaseous impurities. The chunks may consist of, for example, lanthanum, yttrium or scandium. Chunks of, for example, barium, calcium or lithium may also be present.

When the heat pipe is put into operation, heat originating from a heat source 10 (for example, an electrical or inductive heating element, a gas burner, a solar collector or a radio-isotope) is supplied to the vaporization wall 2. Consequently, sodium evaporates from the gauze layer 4 at the area of the vaporization wall 2. The sodium vapour flows, via the vapor space 5, to the colder condensation wall 3 and condenses thereon, while giving off heat which is discharged through the latter wall. The condensate subsequently flows through the gauze layer 4 back to the vaporization wall 2, where it evaporates again.

While the vapour front, denoted by broken line 11, moves in the direction from the vaporization wall 2 to the condensation wall 3 when the heat pipe is started, an increasing number of chunks of getter 9 is heated (sodium vapour temperature, for example is, approximately 900° C.) and thus thoroughly activated, so that they bind the gaseous impurities present in their vicinity, which offers the great advantages already described above.

Getters, for example, combined in pairs which can be successfully used in non-evacuated sodium heat pipes are given, by way of example, in the table below. The stated quantities of getter have not been optimized.

| Heat pipe (length 350 mm: diameter 35 mm) containing 20 g of Na as the heat transport medium | |
|---|---|
| getter pair | weight (in g) |
| La | 10 |
| Ba | 15 |
| La | 11 |
| Ca | 6 |
| La | 12 |
| Li | 3 |
| Y | 10 |
| Ba | 5 |
| Y | 5 |
| Ca | 5 |
| Y | 6 |
| Li | 3 |
| Sc | 6 |
| Ba | 12 |
| Sc | 4 |
| Ca | 7 |
| Sc | 5 |
| Li | 3 |

What is claimed is:

1. A heat pipe which comprises a closed reservoir having at least one vaporization wall and at least one condensation wall; a heat transport medium in said reservoir for flowing in the vapour phase from the vaporization wall via at least one duct for vapour to the condensation wall during operation and for returning in the liquid phase via at least one duct for liquid to the vaporization wall; and at least one getter for gaseous impurities provided in said vapour duct and extending from the vaporization wall to the condensation wall and active at least at the operating temperature.

2. A heat pipe according to claim 1, in which the getter is sub-divided into portions distributed at intervals from each other over the flow path in the vapour duct.

3. A heat pipe according to claim 2, in which the getter portions are provided at regular intervals from each other.

4. A heat pipe according to claim 2, in which the getter is contained in a gas-permeable holder connected to the reservoir.

5. A heat pipe according to claim 4, in which the gas-permeable holder consists of a roll of metal gauze.

6. A heat pipe according to claim 2, in which the heat transport medium comprises one or more of Na, K, and Cs, and the getter comprises one or more of La, Y, and Sc.

7. A heat pipe according to claim 6, in which the getter comprises one or more of La, Y, and Sc combined with one or more of Ba, Ca, and Li.

* * * * *